United States Patent [19]

Barbee et al.

[11] 4,328,686

[45] May 11, 1982

[54] AUXILIARY YARN FEED FINGER AND PATTERN DRUM SLEEVE FOR CIRCULAR KNITTING MACHINES AND METHOD OF KNITTING THEREWITH

[75] Inventors: Jack C. Barbee, Gastonia; Gene E. Hart, Charlotte, both of N.C.

[73] Assignee: Speizman Industries, Inc., Charlotte, N.C.

[21] Appl. No.: 148,781

[22] Filed: May 12, 1980

[51] Int. Cl.[3] ..... D04B 9/34; D04B 9/38; D04B 15/00; D04B 15/74

[52] U.S. Cl. ..... 66/224; 66/111; 66/131; 66/136; 66/139; 66/236; 66/239

[58] Field of Search ..... 66/133, 134, 136, 137, 66/140 R, 140 S, 131, 139, 224, 231, 236, 239, 240, 125 R

[56] References Cited

U.S. PATENT DOCUMENTS

| | | | |
|---|---|---|---|
| 745,449 | 12/1903 | Mayo | 66/140 R X |
| 1,349,298 | 8/1920 | Scanlin et al. | 66/131 |
| 1,927,683 | 9/1933 | Grothey | 66/133 X |
| 2,062,208 | 11/1936 | Coleman | 66/134 X |
| 2,377,489 | 6/1945 | Getaz | 66/133 X |
| 2,708,838 | 5/1955 | Thurston | 66/140 R X |
| 2,872,795 | 2/1959 | Blais | 66/136 X |
| 3,181,313 | 5/1965 | Crawford et al. | 66/136 X |
| 3,186,191 | 6/1965 | Garner | 66/224 |
| 3,399,551 | 9/1968 | Billi | 66/134 |
| 4,041,735 | 8/1977 | Holder | 66/133 |

*Primary Examiner*—Wm. Carter Reynolds

*Attorney, Agent, or Firm*—Richards, Shefte & Pinckney

[57] ABSTRACT

An improvement for knitting pattern areas with hosiery knitting machines having a rotatable cylinder carrying latch needles therein, a knitting station at which a plurality of yarn feed fingers are independently movable into and out of yarn feeding positions for feeding background yarn at a basic level and pattern yarn at a higher level above the cylinder, and means for selectively positioning the needles at either a basic position for receiving only background yarn or an extended position for receiving both background and pattern yarn, the improvement being an auxiliary feed finger for feeding background yarn at a level more closely spaced from the cylinder than the basic level to needles at the basic position and below the latches of needles at the extended position for floating of the background yarn in knitted pattern areas behind loops of pattern yarn formed by extended position neeldes. An independently rotatable pattern drum sleeve, operatively associated with the yarn feed fingers and auxiliary finger to selectively render them inoperable in response to control thereof by the machine pattern drum, is provided to further expand the machine capability for color effects.

21 Claims, 12 Drawing Figures

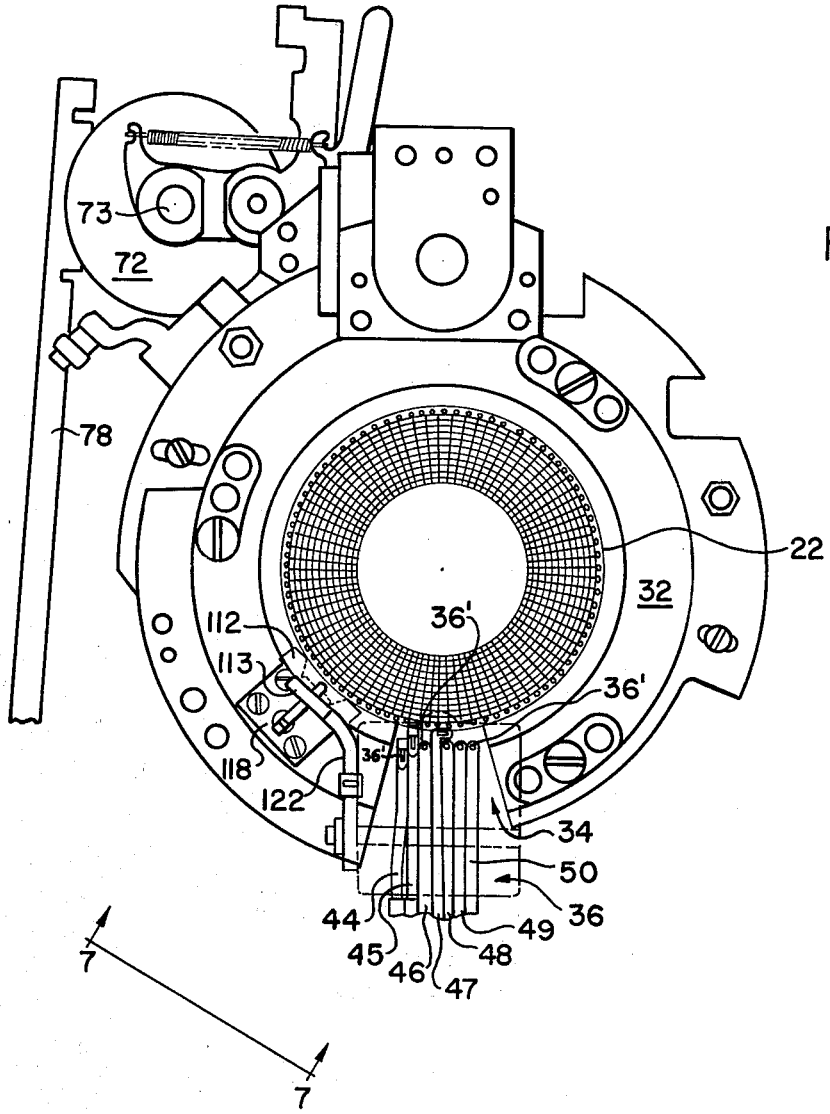
FIG. 2
FIG. 7
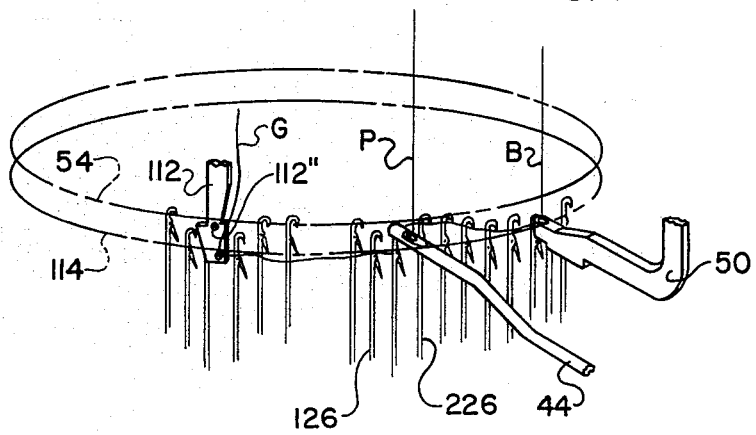

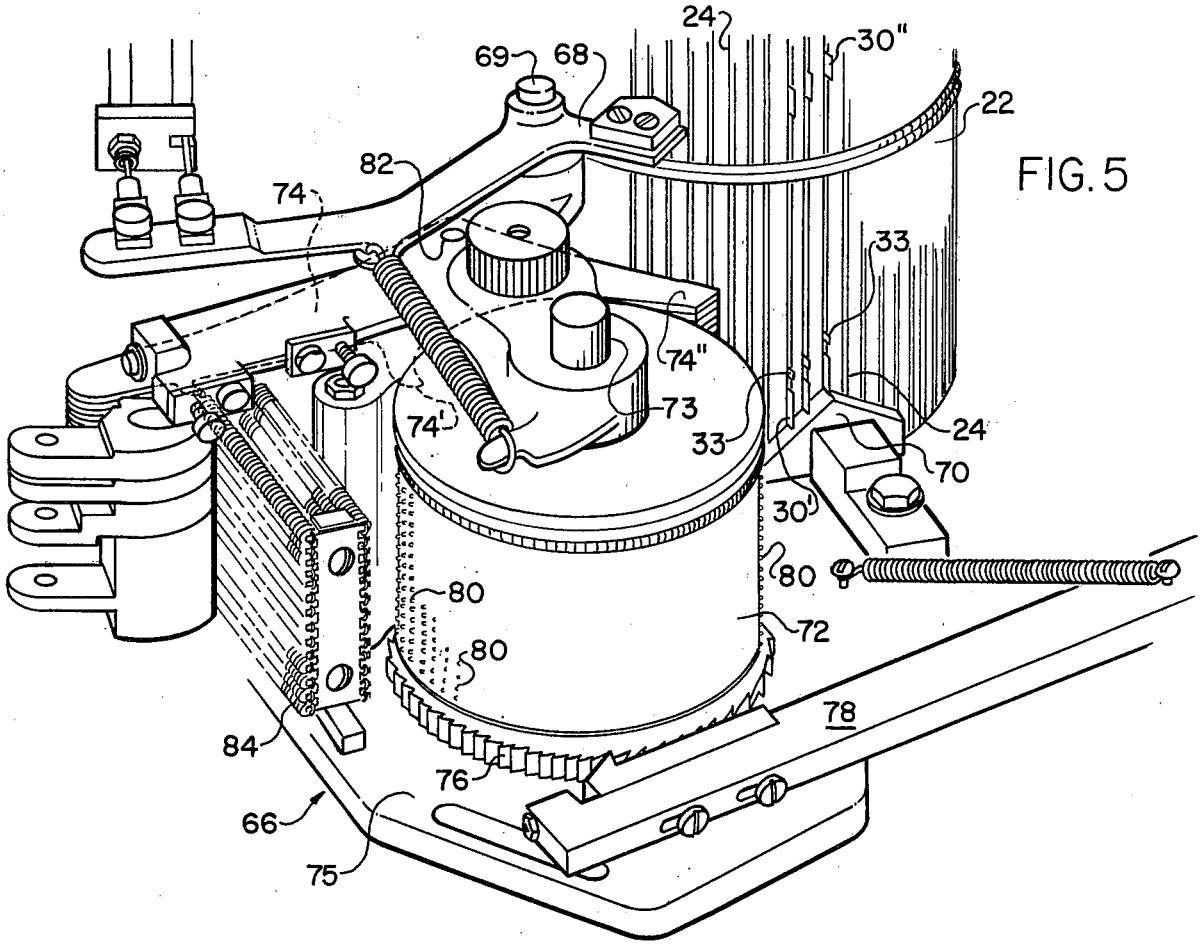
FIG. 5
FIG. 8
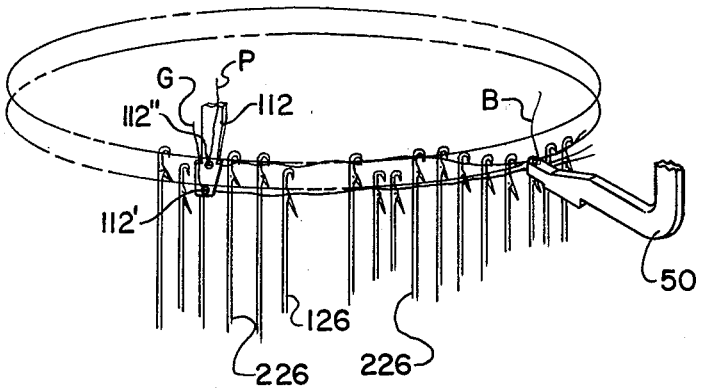

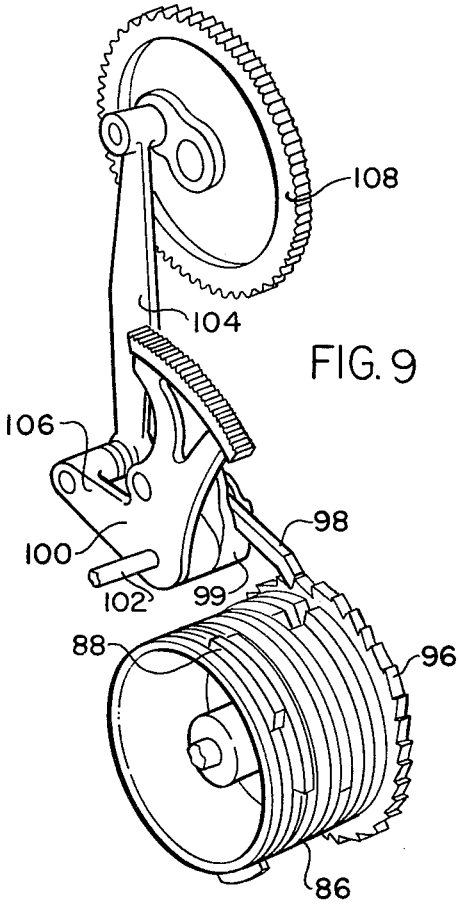
FIG. 9
FIG. 11
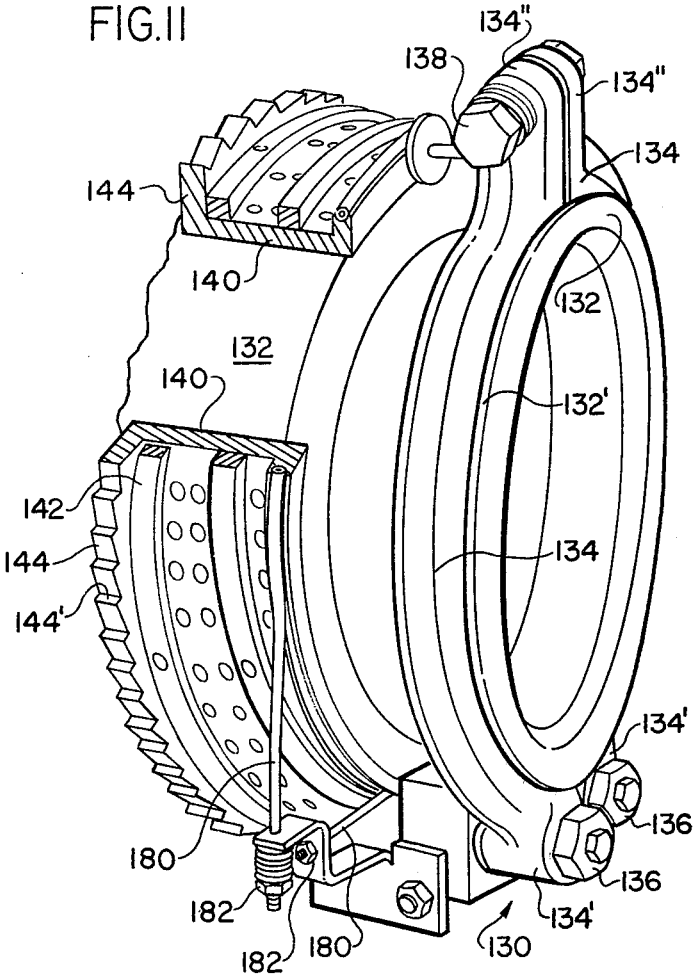
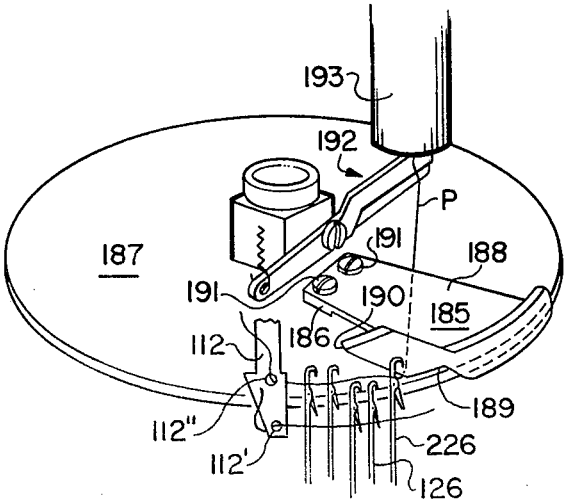
FIG. 12

AUXILIARY YARN FEED FINGER AND PATTERN DRUM SLEEVE FOR CIRCULAR KNITTING MACHINES AND METHOD OF KNITTING THEREWITH

BACKGROUND OF THE INVENTION

The present invention relates to circular knitting machines and to methods of knitting circular or tubular fabric. More specifically, the present invention relates to circular knitting machines of the type having a rotatable cylinder carrying a plurality of needles and a knitting station with which are associated a plurality of yarn feed fingers independently movable into and out of respective yarn feeding positions for selectively feeding yarns to the needles, and relates further to methods of circular knitting practiced with such machines.

Circular knitting machines of the above-described type are normally provided with a relatively small diameter needle cylinder and only a single knitting station, and are conventionally used primarily for the knitting of socks and other hosiery, although such machines and the mechanisms and principles of operation thereof are clearly not so limited. Some of the varieties of types of hosiery produced on such machines include one or more pattern areas in which two or more differently colored yarns are knitted to form a distinctive pattern or design. Typically, such patterns or designs are utilized in the knitting of athletic socks and appear on the leg portion thereof. As will be appreciated by those skilled in the art, such pattern areas are conventionally formed by feeding a pattern yarn or yarns to and knitting such pattern yarn or yarns with only selected needles in the needle cylinder in the formation of each fabric course in the fabric pattern area while a background yarn is fed to and knitted by all of the cylinder needles in forming each such course whereby the pattern yarn appears only in the loops of each course of the pattern area of the fabric formed by the selected needles to which it is fed. The yarn feed fingers of most such machines are capable of feeding yarn to the needles at either a basic yarn feeding level spaced from an end of the needle cylinder or a pattern yarn feeding level spaced farther from the end of the cylinder, and therefore this feeding and knitting of the background and pattern yarns is conventionally accomplished in such machines by utilizing a feed finger capable of feeding yarn at the basic level for feeding the background yarn and utilizing a feed finger capable of feeding yarn at the pattern yarn feeding level for feeding the pattern yarn and by selectively positioning each of the cylinder needles for movement during cylinder rotation through the knitting station in axial projection from the end of the cylinder at either of two positions for receiving yarn from the feed fingers for knitting, the two positions being a basic position in which the needle projects from the cylinder to a sufficient extent to receive yarn fed at the basic level but will not receive yarn fed at the pattern yarn feeding level and an extended position in which the needle projects from the cylinder to a greater extent than in the basic position for receiving both yarn fed at the pattern yarn feeding level and yarn fed at the basic level.

Although this conventional arrangement on such machines operates effectively to form pattern areas, certain disadvantages exist in the use thereof. It is of primary importance in the formation of such pattern areas that the design formed by the pattern yarn be clearly defined and contrasted against the background area formed by the background yarn and, since both the background yarn and the pattern yarn are received and knitted by each selected needle knitting the pattern portion of the pattern area, it is necessary, to accomplish this, that the pattern yarn be of at least the same yarn count or denier as the background yarn. However, to provide continuity and a unitary appearance to the fabric, it is generally preferable that the pattern yarn be neither of a greater thickness than the background yarn or of a different type yarn. As a result, the problem of the background yarn "grinning" through, i.e. appearing in, the pattern portion of the pattern area is a recurring one in this type of knitting. Moreover, with this arrangement, the design portion of the pattern area is necessarily twice as bulky as the remaining portions of the fabric since both the pattern and background yarns are knitted therein, this resulting not only in an undesirable bulky and uneven appearance but also creating a strange feel to the hosiery fabric when worn.

In circular knitting machines of the type having a relatively large cylinder diameter and more than one knitting station, it is conventionally possible to knit pattern areas utilizing two knitting stations for separate feeding and knitting of the pattern and background yarns. Thus, for example, at one knitting station selected needles can be raised to a yarn receiving position, a pattern yarn fed thereto, and the selected needles manipulated to knit loops of such yarn all while the other cylinder needles are inactive, and, at the other knitting station, the other needles can be raised to the yarn receiving position, a background yarn fed thereto, and such other needles manipulated to knit loops of such background yarn while the needles which were active at the first knitting station are inactive. In this manner, neither the pattern yarn nor the background yarn is knitting in plating relationship with each other or with any other yarn, the background yarn floating behind loops of the pattern yarn and the pattern yarn floating behind loops of the background yarn. Importantly, this manner of knitting pattern areas is utilized almost exclusively for patterns which extend substantially around the entirety of the tubular fabric whereby both the pattern and background yarns are fully integrated in the fabric. Since the circular hosiery knitting machines of the type described above are conventionally provided with only a single knitting station, this manner of knitting pattern areas is not adaptable to such machines. Such hosiery machines, of necessity, must rely on the feeding of the pattern and background yarns at different levels and the positioning of the cylinder needles at different yarn receiving positions to achieve patterning and, due to the above-described conventional arrangement of the yarn feed fingers and needle positioning means of such hosiery machines, floating of the background yarn behind the pattern area is not conventionally possible. Moreover, the pattern portions of hosiery pattern areas conventionally knitted with such hosiery machines do not normally extend substantially around the entirety of the hosiery fabric knitted but instead appear at only one location thereon or are spaced at relatively substantial spacings around the tubular hosiery fabric, the pattern yarn normally being severed at the back of the hosiery fabric on opposite sides of the pattern. As a result, the manner of knitting pattern areas utilized by circular machines having more than one knitting station would not be feasible in knitting conventional hosiery patterns because the pattern and background portions of the hosiery would be separable.

Hosiery knit on this type of circular knitting machine additionally often include other types of special color effects, such as stripes, and in certain instances it is desirable that hosiery include both a pattern area and another type of color effect. One of the major limitations of conventional hosiery knitting machines in knitting such types of hosiery is the relatively limited capability of the main pattern drum and pattern chain assembly of the machine for diverse control of the yarn feed fingers thereof. Because the pattern drum is the sole means for controlling the movements of the yarn feed fingers into and out of their respective yarn feeding positions, it is necessary to utilize relatively large and cumbersome pattern drum and pattern chain arrangements to increase the capabilities of conventional machines for knitting such special color effects. In some cases, the size and complexity of the pattern drum and chain assembly necessary to knit hosiery with complex special color effects proves to be prohibitive.

In contrast to the above, the present invention provides an improvement in circular knitting machines of the type described and in the method of circular knitting utilizing same whereby, in knitting a pattern area, the background and pattern yarns may be selectively fed to and knitted by the needles at the basic and extended positions, respectively, so that the background yarn is not knitted by the needles knitting loops of pattern yarn but instead floats behind such loops in the knitted fabric and cannot grin through the pattern in the knitted fabric. Additionally, the present invention provides an independently operable means of controlling the movements of the yarn feed fingers in conjunction with the control thereof by the main pattern drum and thereby provides a means of significantly increasing the capacity of conventional hosiery knitting machines for knitting hosiery with complex striping and special color effects without increasing the size of the main pattern drum thereof and its associated pattern chain assembly.

SUMMARY OF THE INVENTION

The present invention provides an improvement in a circular knitting machine of the type having a rotatable needle cylinder carrying a plurality of needles therein, a knitting station, a plurality of yarn feed fingers associated with the knitting station and independently movable into and out of respective yarn feeding positions for selectively feeding yarns to the needles, and means for manipulating the needles axially of the cylinder for projection from one end thereof to receive yarn for knitting from the feed fingers, the needle manipulating means including means for selectively positioning each needle in axial projection from the end of the cylinder at either of two positions for receiving yarn for knitting. The two yarn receiving positions of the needles are a basic position for receiving yarn fed at a basic yarn feeding level spaced from the end of the cylinder and an extended position in which the needles project from the end of the cylinder to a greater axial extent than in the basic position for receiving both pattern yarn fed at a pattern yarn feeding level spaced farther from the end of the cylinder than the basic level and yarn fed at the basic level.

In accordance with the present invention, an auxiliary yarn feed finger is provided, the auxiliary finger being selectively movable into and out of a yarn feeding position for selectively feeding a pattern background yarn at a yarn feeding level more closely spaced from the end of the cylinder than the basic level for receipt by needles at the basic position for knitting without being received for knitting by needles at the extended position whereby the pattern background yarn floats behind loops of pattern yarn formed by the needles at the extended position that receive pattern yarn. In one embodiment of the present invention, one of the plurality of feed fingers is a pattern yarn feed finger and is adapted for feeding at its yarn feeding position a pattern yarn at the pattern yarn feeding level. In another embodiment of the present invention, the auxiliary feed finger is adapted for feeding at its yarn feeding position a pattern yarn at the pattern yarn feeding level simultaneously with its feeding of the pattern background yarn.

In the preferred embodiment of the present invention, the needles are latch needles each having an openable latch assembly thereon for projection from the end of the cylinder with the latch assembly open for receiving yarn for knitting and the pattern background yarn feeding level of the auxiliary feed finger is at a sufficiently closer spacing from the end of the cylinder than the basic level axially inwardly of the latch assemblies of needles at the extended position so that the pattern background yarn will not be received for knitting by the latch assemblies of needles at the extended position but will be presented to and received by the latch assemblies of needles in the basic position. The knitting machine also preferably includes a latch ring at the end of the cylinder for engaging the latches of the needles when the latches are open to maintain them open for receiving yarn for knitting, the latch ring including a throat area within which each of the plurality of yarn feed fingers is disposed when in its respective yarn feeding position. To provide a space for movement of the auxiliary feed finger into and out of yarn feeding position, the ring is provided with a slot formed therein in general alignment with the axis of the cylinder for movement of the auxiliary feed finger therein. The auxiliary feed finger is provided with a cam surface thereon for engaging the open latches of the needles when the auxiliary feed finger is in its feeding position to maintain the needle latches open for receiving yarn.

According to the preferred embodiment, the knitting station includes center cam means for moving the needles from the extended position to the basic position, the means for selectively positioning needles is disposed in advance of the knitting station, and the auxiliary feed finger is disposed intermediate the means for selectively positioning needles and the knitting station center cam means. In conjunction therewith, one of the plurality of yarn feed fingers is a base yarn feed finger disposed at the knitting station following the center cam means and adapted for feeding at its yarn feeding position a base yarn at the basic level to all of the cylinder needles after the moving of the needles by the center cam means to the basic position. Preferably, the auxiliary feed finger and the base yarn feed finger are operatively connected for concerted movement thereof into and out of their respective yarn feeding positions. To effect proper plating of the pattern yarn with respect to the base yarn for appearance of the loops of the pattern yarn knitted by the needles at the extended position on the face of the fabric, means are provided, in the aforementioned another embodiment in which the pattern yarn is fed by the auxiliary feed finger, for engaging the pattern yarn during the initial feeding and receipt thereof by needles at the extended position to move the pattern yarn on the needles at the extended position to a closer spacing to the end of the cylinder than the base yarn. The circular knitting machine of the present invention also includes a pattern drum assembly for controlling the various mechanical functions of the machine and specifically for controlling movement of the yarn feeding fingers, the pattern drum assembly including a pattern drum operatively associated with the yarn feed fingers for controlling the movements thereof into and out of their respective yarn feeding positions. According to the present invention, a pattern drum sleeve is supported coaxially about the pattern drum for independent rotation thereon, the pattern drum sleeve being operatively associated with at least some of the plurality of yarn feed fingers and with the auxiliary feed finger for selectively rendering the some yarn feed fingers and the auxiliary feed finger inoperative in response to the control thereof by the pattern drum.

According to the preferred embodiment of the present invention, a plurality of yarn feed finger disengaging levers are associated with the some feed fingers for independently moving the some feed fingers out of their respective yarn feeding positions, the pattern drum sleeve being independently operatively associated with each of the yarn feed finger disengaging levers for selectively and independently controlling movement of each of the some yarn feed fingers out of their respective yarn feeding positions. The pattern drum assembly additionally includes means for rotating the pattern drum and brake means for preventing movement of the pattern drum other than by the pattern drum rotating means. Preferably, the present invention includes means for rotating the pattern drum sleeve independent of the pattern drum and pattern drum sleeve brake means operable to prevent movement of the pattern drum sleeve other than by the pattern drum sleeve rotating means.

BRIEF DESCRIPTION OF THE DRAWINGS

FIG. 2 is a top plan view of the needle cylinder of the knitting machine of FIG. 1;

FIG. 5 is a perspective view of the means of the knitting machine of FIG. 1 for selectively positioning the cylinder needles thereof in axial projection from the top end of the cylinder in yarn receiving position;

FIG. 7 is a perspective view of the auxiliary yarn feed finger, the conventional number one pattern feed finger and the conventional number seven feed finger of the knitting machine of FIG. 1 taken along line 7—7 of FIG. 2 and illustrating one embodiment of the present invention;

FIG. 8 is a perspective view similar to FIG. 7 of the auxiliary yarn feed finger and the conventional number seven feed finger of the knitting machine of FIG. 1 illustrating another embodiment of the present invention;

FIG. 9 is a perspective view of the pattern drum rotating means of the knitting machine of FIG. 1;

FIG. 11 is a perspective view of the pattern drum brake means and the pattern drum sleeve brake means of the knitting machine of FIG. 1; and FIG. 12 is a perspective view of the means utilized in the embodiment of FIG. 8 for moving the pattern yarn lower within the latches of the needles than the base yarn to effect proper plating of the yarns.

DESCRIPTION OF THE PREFERRED EMBODIMENT

For the purpose of providing a full disclosure of the preferred embodiment of the improvement of the present invention, the present invention is illustrated and described herein as incorporated in a conventional Reading Mark III model circular hosiery knitting machine manufactured by the now-defunct Textile Machine Works of Reading, Pennsylvania. However, inasmuch as the present invention utilizes the conventional knitting elements of such machine without modification of such elements or the functions thereof and does not involve any change in the basic cooperation of the elements in carrying out the knitting operation, it should be understood that the improvement of the present invention may be readily embodied in various other circular knitting machines of the general type of the Reading Mark III machine.

Figure 1:
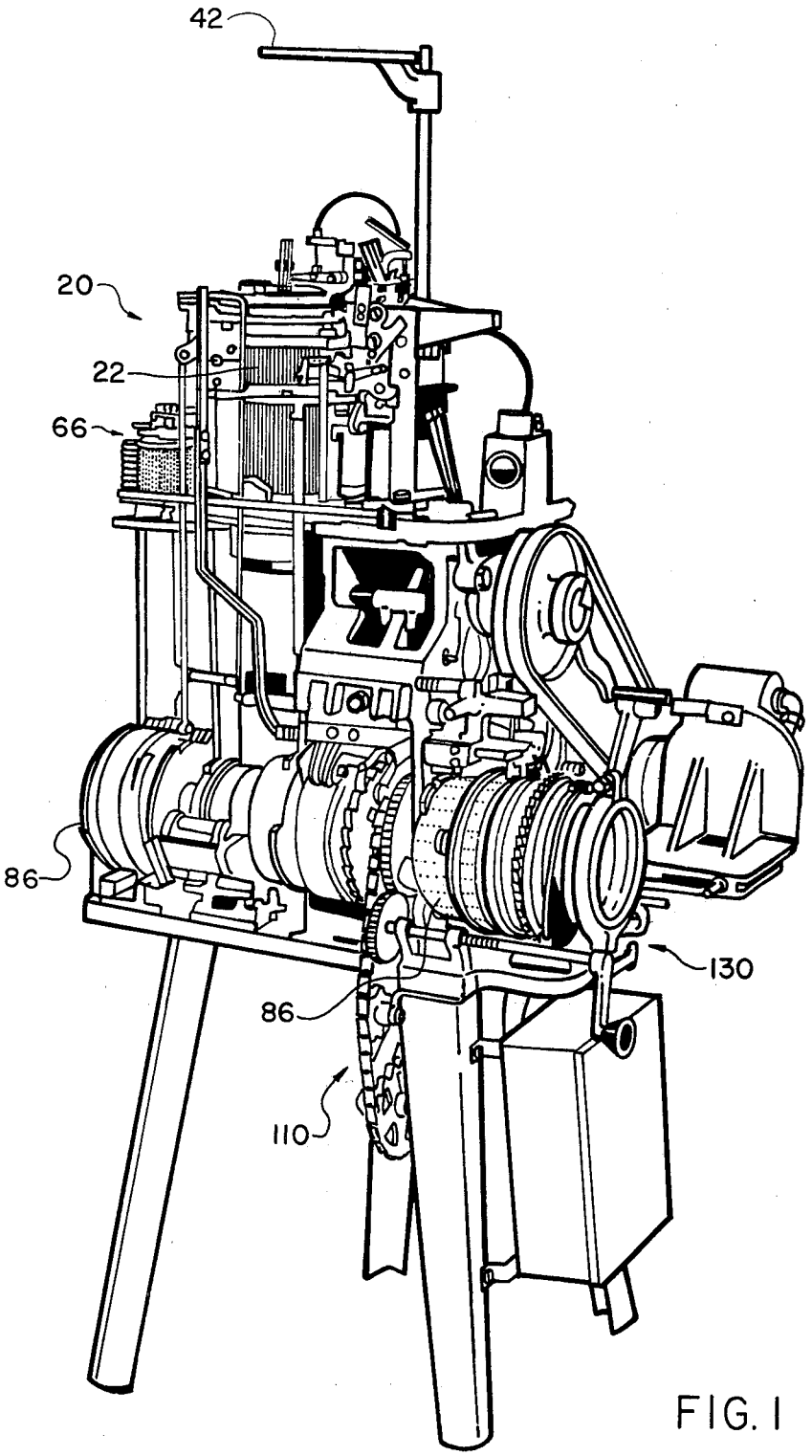
FIG. 1 is a front side perspective view of a conventional circular hosiery knitting machine in which the preferred embodiment of the present invention has been incorporated.

Referring now to the accompanying drawings, the particular knitting machine illustrated is indicated generally at 20 in FIG. 1 and is of the conventional type having a rotatable needle cylinder 22 having a plurality of axially extending slots 24 formed in the outer circumference thereof with a respective plurality of latch needles 26 slidably disposed in the slots 24. The needle cylinder 22 is vertically disposed with the needles 26 being positioned in the slots 24 adjacent the upper end of the cylinder 22 whereby the needles 26 may be axially manipulated within the slots 24 to project from the upper end of the cylinder 22 for receiving yarn for knitting. As in conventional, each latch needle 26 has an openable latch assembly 27 at the upper end thereof for receiving yarn therein upon axial projection thereof from the cylinder 22. Also disposed in each cylinder slot 24 below the needle 26 disposed therein are two needle jacks 28, 30, the needles 26 and jacks 28, 30 being provided with control butts 26', 28' and 30', respectively, which extend radially outwardly of the cylinder 22 from its slots 24. Operational control of the axial movement of the needles 26 is by conventional stationary camming means (FIG. 6), described hereinafter, disposed radially outwardly of the needle cylinder 22 in close adjacency thereto for manipulative engagement of the needle and jack butts 26', 28', 30'. To insure that the latch assemblies 27 of the needles 26 open for receiving yarn as the needles 26 are manipulated into axial projection from the upper end of the cylinder 22 and to insure that the latch assemblies 27 of the needles 26 remain open during such projection, the knitting machine 20 includes a latch ring 32 generally closely encircling the upper end of the cylinder 22 for engaging and pivoting open the latches 27' of the latch assemblies 27 of the needles as they are projected axially from the cylinder 22.

Figure 3:
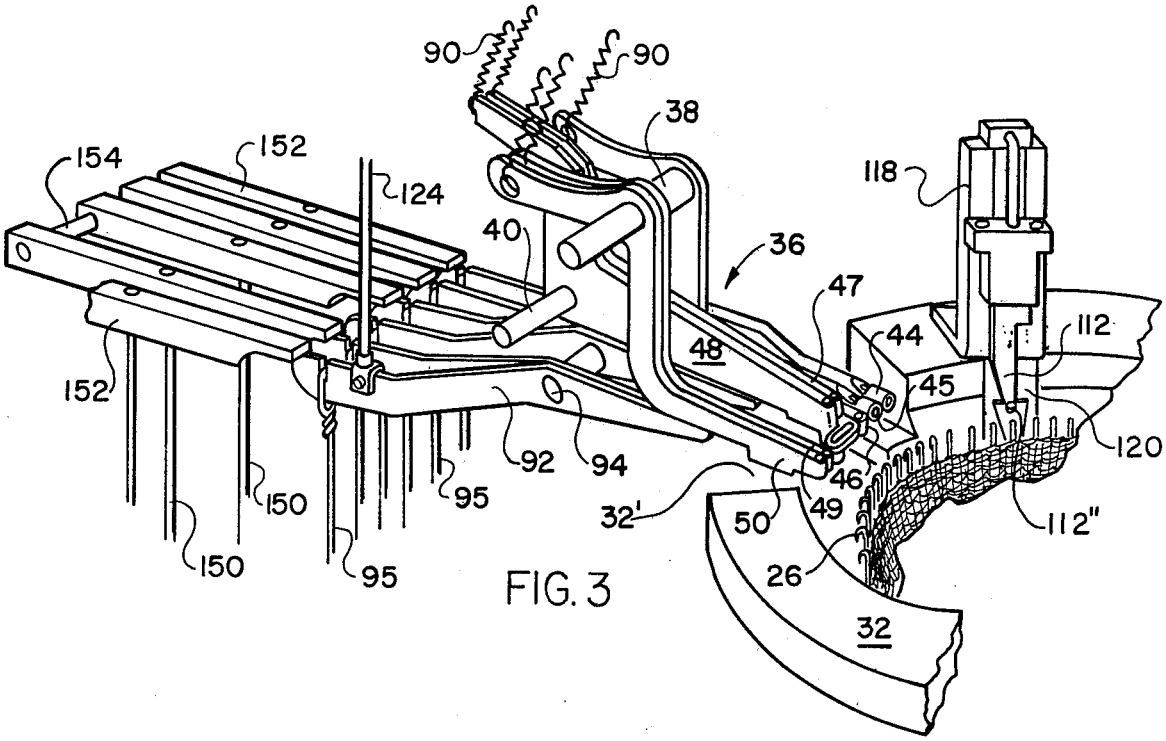
FIG. 3 is a perspective view of the yarn feed finger assembly of the knitting machine of FIG. 1.

As with many conventional hosiery knitting machines, the knitting machine 20 is provided with only one knitting station, indicated generally at 34 in FIG. 2, at which the yarn feeding and knitting operations are effected. As best seen in FIG. 2 and 3, seven yarn feed fingers, indicated generally at 36, of conventional construction are disposed at the knitting station 34 and are associated therewith for feeding yarn to the needles 26 for knitting, each of the feed fingers 36 being pivotable within an open throat area 32' in the latch ring 32 for independent movement between a respective yarn feeding position adjacent the upper end of the cylinder 22 for supplying yarn to the needles 26 and an inactive position spaced upwardly from the cylinder 22. For this purpose, three of the feed fingers 36 are pivotably mounted on a horizontal shaft 38 extending between two upright support members (not shown) extending from the latch ring 32 on opposite sides of the throat area 32', the remaining four feed fingers 36 being pivotably mounted on another horizontal shaft 40 which also extends between the upright support members. Yarns for knitting are supplied from yarn packages (not shown) supported on a platform 42 disposed generally above the needle cylinder 22 and are trained through various yarn guide eyelets (not shown) and through eyelets 36' at the ends of the feed fingers 36.

As hereinbefore noted, circular knitting machines of the type of the knitting machine 20 illustrated and described herein are often utilized to produce hosiery having one or more pattern areas comprising differently colored yarns selectively knitted to form a distincitive design, such pattern areas being conventionally formed by feeding a pattern yarn or yarns to and knitting such yarn or yarns with only selected ones of the cylinder needles in the formation of each fabric course in the pattern area while a background yarn is fed to and knitted by all of the cylinder needles in forming each such course. In this manner, the pattern yarn appears only in the loops of each course of the pattern area of the hosiery fabric formed by the selected needles to which it is fed. Conventionally, this is accomplished by (a) utilizing the several yarn feed fingers of the machine to feed several different yarns at different spacings or levels above the upper end of the needle cylinder, the pattern yarn or yarns being fed at a greater spacing above the cylinder than the background yarn, and (b) selectively positioning the cylinder needles in axial projection from the upper end of the cylinder at different yarn receiving positions with only selected needles projecting from the cylinder sufficiently to receive the pattern yarn or yarns.

In accordance with this conventional practice, the seven yarn feed fingers 36 of the knitting machine 20 are collectively adapted to feed different yarns to the cylinder needles 26 at different yarn feeding levels in the knitting of hosiery. For purposes of clarity of explanation, the reference numeral 36 will be further used hereinafter only to identify collectively the seven yarn feed fingers of the knitting machine 20, the individual yarn feed fingers being hereinafter referred to as yarn feed finger numbers one through seven, as seen from left to right in FIG. 2 and right to left in FIG. 3, and being respectively identified by reference numerals 44 through 50, inclusive. Referring now to the diagrammatic illustration of FIG. 6, these seven yarn feed fingers 36 are adapted for feeding yarns to the cylinder needles 26 at either a basic yarn feeding level 52 spaced slightly above the upper end of the cylinder 22 or a pattern yarn feeding level 54 spaced farther above the upper end of the needle cylinder 22 than the basic level 52. As is conventional, the throat area 32' of the latch ring 32 in which area the feed fingers 36 move into and out of their respective yarn feeding positions is provided with a throat plate 56 extending across the throat area 32' against the top of which a yarn feed finger rests when feeding yarn at the basic yarn feeding level, the throat plate 56 thereby serving as a reference surface for positioning the yarn feed fingers for feeding at the basic level. Of the seven yarn feed fingers 36 of the knitting machine 20, only numbers one and two feed fingers 44 and 46, respectively, are conventionally adapted for feeding pattern yarn at the pattern yarn feeding level 54. Numbers three, six and seven feed fingers 46, 49 and 50, respectively, are adapted for feeding at their respective yarn feeding positions respective yarns at the basic level 52. Numbers four and five feed fingers 47 and 48, respectively, are conventionally used for conjunctively feeding two yarns to the needles 26 at slightly different heights with respect to the sinkers (not shown) of the knitting machine 20, for knitting terry fabric portions of hosiery and are not conventionally utilized in knitting pattern areas.

Figure 6:
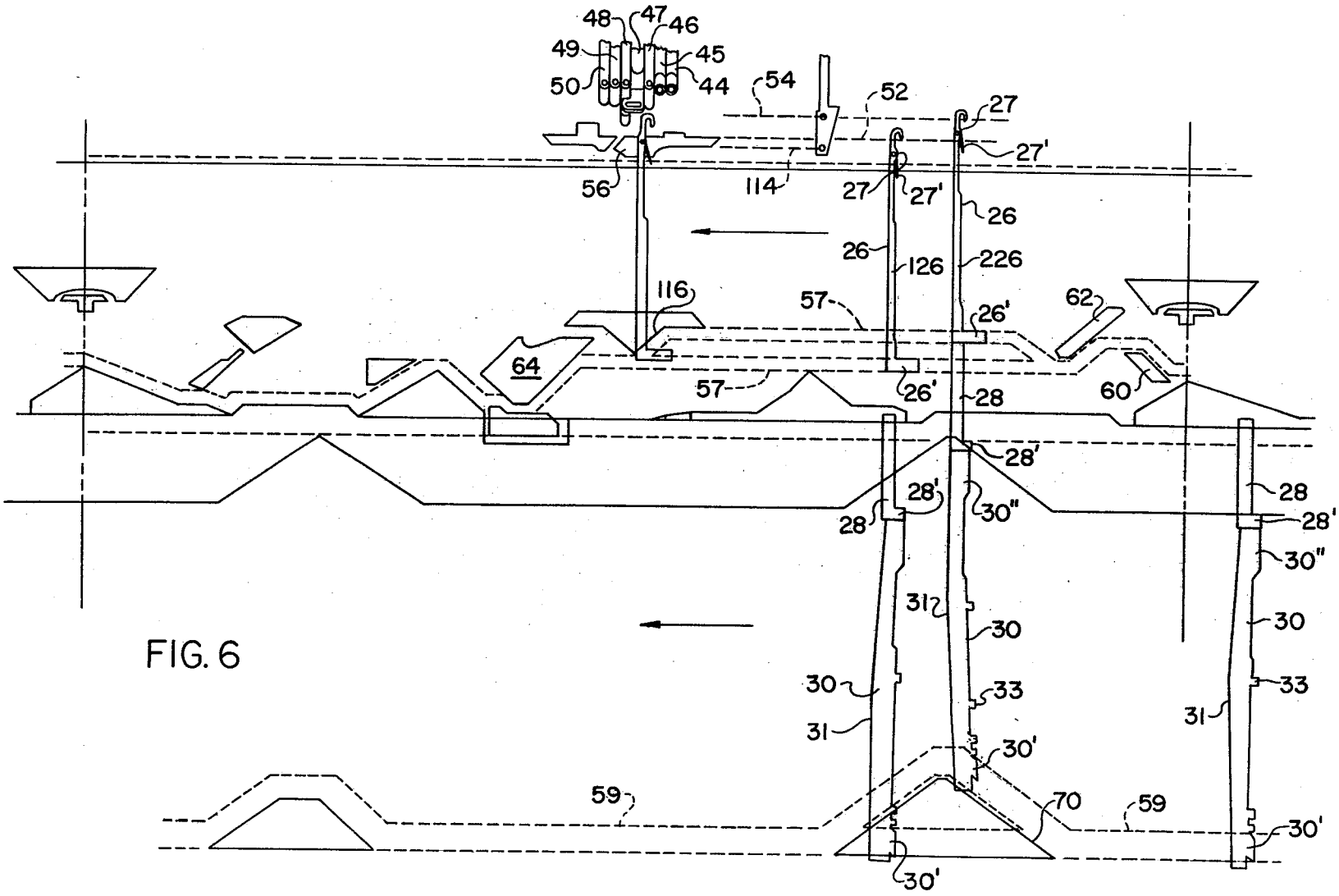
FIG. 6 is an elevational layout view of the cylinder needle and needle jack camming means of the knitting machine of FIG. 1 as viewed from the axis of the needle cylinder thereof.

In additional accordance with the above-described conventional manner of patterning with circular hosiery knitting .machines, the conventional stationary camming means of the knitting machine 20 for axially manipulating the cylinder needles 26 includes means for selectively positioning each of the needles 26 in axial projection from the upper end of the cylinder 22 at either of two positions for receiving yarn for knitting: a basic position, represented in FIG. 6 by the needles 126, and an extended position, represented in FIG. 6 by the needles 226, in which the needles project from the upper end of the cylinder 22 to a greater extent than in the basic position. Needles 126 in the basic position are properly disposed for receiving in the latch assemblies 27 thereof yarn fed by the yarn feed fingers 36 at the basic yarn feeding level 52 but do not project from the upper end of the cylinder 22 sufficiently to receive the pattern yarn fed at the pattern yarn feeding level 54. Needles 226 in the extended position are properly disposed for receiving in the latch assemblies 27 thereof pattern yarn fed by the yarn feed fingers 36 at the pattern yarn feeding level 54. However, as can be seen in FIG. 6, the needles 226 in the extended position are not projected sufficiently farther than the needles 126 in the basic position to prevent their also receiving in the latch assemblies 27 thereof yarn fed at the basic yarn feeding level 52. Thus, by utilizing the needle positioning means of the stationary camming means of the knitting machine 20 in the knitting of certain fabric courses to selectively position certain cylinder needles 226 at the extended position while feeding in the knitting of such courses a pattern yarn at the pattern yarn feeding level 54 and a background yarn at the basic yarn feeding level 52, a pattern area of the above-described conventional type can be knitted.

The above-mentioned needle positioning means of the stationary camming means of the knitting machine 20 is illustrated in FIGS. 5 and 6 in which directional arrows have been inserted to indicate the direction of needle cylinder rotation. In FIG. 6, the paths followed by the needle and jack butts 26' and 30', respectively, have been indicated at 57 and 59 and, as can be seen in that figure, the butt 26′ of each needle 26 is initially manipulatively engaged upon beginning each cylinder revolution during knitting by a clearing cam 60 which raises the needle 26 within its slot 24 to insure that the loop of yarn carried within the latch assembly 27 of the needle 26 is cleared of the latch assembly 27 and positioned about the stem of the needle 26 in preparation for receiving another yarn for knitting. Each needle butt 26′ is engaged immediately subsequent to this clearing operation by a leveling cam 62 which lowers the needles 26 to the aforementioned basic position in proper axial projection for receiving yarn fed at the aforementioned basic yarn feeding level 52. In the knitting of non-pattern areas in the hosiery fabric, the needles 26 are not further manipulated until after receiving yarn in the latch assemblies 27 thereof whereupon they are manipulated downwardly within their slots 24 by the engagement of their butts 26′ against the stitch cam 64 to draw loops of yarn through the previously cleared loops of the preceding fabric course. However, in the knitting of pattern areas of the hosiery fabric, a needle selecting assembly, illustrated in FIG. 5 and indicated generally therein at 66, operates immediately subsequent to the leveling cam 62 to effect the raising of selected needles 26 from the basic position to the aforementioned extended position. The needle selecting assembly 66 of FIG. 5 is conventional and is operative to selectively raise the jacks 30 disposed in the slots 24 of the needles 26 to be raised to the extended position, thereby raising such needles.

To facilitate the selective raising of certain jacks 30, the rear edge 31 of each jack 30, which edge faces radially inwardly of the cylinder 22 in its slot 24, is slightly curved outwardly from a point on the rear edge 31 intermediate the upper and lower ends of the jack 30, all as can best be seen in FIG. 6. Thus, this intermediate point on each jack 30 can act within the cylinder slot 24 of the jack 30 as a fulcrum, and radially inward engagement of the jack 30 at a point on the jack 30 above or below the intermediate point will cause that end to pivot inwardly within its cylinder slot 24 and will cause the other end of the jack 30 to pivot and extend radially outwardly from its cylinder slot 24. As can be seen in FIG. 5, a jack presser arm 68 is disposed adjacent the periphery of the needle cylinder 22 generally midway between the upper and lower ends thereof and is pivotable about a vertical shaft 69 for pivotal movement into and out of radially inward pressing engagement with the upper end butt 30″ of each jack 30 to effect outward pivoting of the lower ends of the jacks 30 and their control butts 30′, the jack presser arm 68 being thus operated throughout the knitting of any pattern area. A jack raising cam 70 is disposed adjacent the periphery of the needle cylinder 22 at the lower end thereof following the jack presser arm 68 in the direction of cylinder rotation for engaging the control butts 30′ of the jacks 30 whose control butts 30′ extend radially outwardly from the cylinder slots 24 and thereby raising such jacks 30 within their cylinder slots 24, the jack raising cam 70 being profiled such that the jacks 30 engaged thereby are raised sufficiently to effect the raising of their associated needles 26 to the aforementioned extended position.

To effect the selection of certain of the jacks 30 engaged by the jack presser arm 68 for engagement with the jack raising cam 70, a rotatable jack selector drum 72 and a plurality of jack selector levers 74 associated therewith are disposed intermediate the jack presser arm 68 and the jack raising cam 70 to selectively pressingly engage the lower end of certain jacks 30 radially inwardly of the cylinder 22 to pivot their respective control butts 30′ inwardly out of disposition for engagement of the jack raising cam 70. The jack selector drum 72 is mounted on a platform 75 adjacent the lower end of the cylinder 22 for rotation about a vertical axis 73. Rigidly affixed coaxially to the lower end of the selector drum 72 is a toothed ratchet-wheel 76, a rack pawl 78, operatively associated at one end thereof with an eccentric cam (not shown) in the main drive means of the machine 20 for reciprocation of the pawl 78, being provided for drivingly engaging at the other end of the pawl 78 the teeth of the ratchet-wheel 76 to effect stepwise rotation of the selector drum 72. The selector drum 72 is provided with a plurality of pins 80 in the outer circumferential surface thereof, the pins 80 forming a plurality of horizontal circumferentially extending rows of pins 80. A respective plurality of jack selector levers 74 are pivotably mounted on a vertical shaft 82 adjacent the selector drum 72, each lever 74 having a drum reading arm 74′ biased into following engagement with a respective row of pins 80 by springs 84 and another extending arm 74″ biased by the springs 84 toward the cylinder 22. As is best seen in FIG. 6, most of the jacks 30 are provided with one or more smaller secondary control butts 33 intermediate the butts 30′ and 30″, these butts 33 being located at varying points on the jacks 30 corresponding to one of the selector levers 74 for engagement by the arms 74″ of the levers 74. Thus, as will be readily understood by those skilled in the art, the presence or absence of pins 80 in the circumferential rows of the selector drum 72 and the presence or absence of butts 33 on the jacks 30 conjunctively and cooperatively determine the selective engagement of certain jacks to pivot their control butts 30′ out of position for engagement by the jack raising cam 70. More specifically, the presence of pins 80 in the circumferential rows of the selector drum 72 will maintain arms 74″ of the selector levers 74 associated with the rows pivoted about the shaft 82 out of engagement with the cylinder 22. However, the absence of a pin 80 in one of the rows will permit the selector lever 74 associated in following engagement with the row to be pivoted under the biasing force of its respective spring 84 into engagement with the periphery of the cylinder 22. Only those jacks 30 in the cylinder 22 which have butts 33 located correspondingly with the selector levers 74 pivoted into engagement with the cylinder 22 and which are rotated past the selector drum 72 and levers 74 while such selector levers 74 are so pivoted will be engaged so as to pivot the control butts 30′ thereof into their respective slots 24 out of disposition for engagement by the jack raising cam 70.

The knitting machine 20 is also provided with a conventional rotatable pattern drum 86 for providing operative control of the movements of various operating components of the machine 20. As can be seen in FIG. 1, the pattern drum 86 is disposed at the front side of the machine 20 generally below the needle cylinder 22 and extends generally horizontally across substantially the entire width of the machine 20. As can best be seen in FIG. 9, in which only a portion of the entire width of the drum 86 is illustrated, a plurality of cam surfaces 88 are circumferentially disposed on the periphery of the drum 86. As is conventional, a respective plurality of pivotable drum reading levers (not shown) are disposed in following engagement with the periphery of the drum 86 for pivotal movement upon engagement of a cam surface 88 during rotation of the drum 86, each drum reading lever being operatively associated by means of a conventional Bowden cable (not shown) with an operating component of the knitting machine 20 for actuating or deactuating operational movement thereof upon pivotal movement of the lever. It is in this conventional manner that the drum 86 operatively controls the manipulation into and out of yarn feeding position of the seven yarn feed fingers 36. With regard to number one yarn feed finger 44, a Bowden cable (not shown) is directly affixed at one end thereof to a pattern drum reading lever and at the other end thereof to the number one feed finger 44 to provide direct translatory control of the movement of the finger 44 in response to the reading by the associated drum reading lever of the presence or absence of cam surfaces 88 on the periphery of the drum 86. In contrast, each of the numbers two through seven feed fingers 45, 46, 47, 48, 49, 50 is biased toward its respective yarn feeding position by a spring 90 and is provided with a respective feed finger lifter lever 92 for selectively permitting or preventing movement of its associated feed finger into its yarn feeding position, each feed finger lifter lever 92 being pivotably mounted on a horizontal shaft 94 in dispostion below its respective feed finger for engagement with the underside thereof to selectively lift the feed finger against the biasing force of its spring 90 out of its feeding position or lower the feed finger into its feeding position under the biasing force of its spring 90, such pivotal movement of each feed finger lifter lever 92 being controlled from the pattern drum 86 by means of a respective Bowden cable 95 attached to the rearwardly extending end of the lifter lever 92, all as is conventional. The pattern drum 86 of the knitting machine 20 is rotated by rotating means comprising a conventional pattern drum racking assembly, illustrated in FIG. 9, which comprises generally an irregularly toothed rack wheel 96 rigidly affixed coaxially with the pattern drum 86 for rotation therewith, a racking pawl 98 disposed for driving engagement in the teeth of the rack wheel 96, and means for reciprocating the racking pawl 98 to effect stepwise rotation of the pattern drum 86. As can be seen in FIG. 9, the racking pawl 98 is pivotably mounted in a bracket portion 99 rigidly affixed to a segment or guardrant gear 100 which is mounted on and is constantly rotatably reciprocated about a shaft 102 by a vertically reciprocating connecting link 104 pivotably affixed at one end thereof to an outwardly extending leg 106 of the segment gear 100 and pivotably affixed at the other end thereof eccentrically to a constantly rotating timing gear 108 in the main driving means of the knitting machine 20 for reciprocal driving of the connecting link 104 thereby. This reciprocation of the segment gear 100 effects reciprocal longitudinal movement of the racking pawl 98 to effect stepwise rotation of the pattern drum 86. As is also conventional, the pattern drum 86 of the knitting machine 20 also includes a pattern chain assembly generally comprising an independently rotatably sprocket (not shown) about which is trained in meshing engagement therewith a conventional pattern chain (indicated generally at 110 in FIG. 1)having a plurality of chain links therein, a chain reading pawl (also not shown) being provided in following engagement with the pattern chain and being operatively associated with the racking pawl 98 for maintaining the racking pawl 98 out of engagement with the teeth of the rack wheel 96 except as determined by the location of links in the pattern chain.

The knitting machine 20 also includes conventional pattern drum brake means, indicated generally in FIG. 11 at 130, for creating a drag of resistance against rotation of the pattern drum 86 to prevent rotational movement of the pattern drum 86 other than by the above-described pattern drum racking assembly and thereby prevent the disruption of the ordinary completion of the program of the pattern drum and chain assembly. As best seen in FIG. 11, the pattern drum brake means 130 includes a brake drum 132 rigidly affixed coaxially to the right end of the pattern drum 86 for rotation therewith, the brake drum 132 including a channel 132' at the outwardly facing right end thereof. Carried within the channel 132' are two arcuately-shaped brake shoes 134, each brake shoe 134 having a bracket 134' formed in one end thereof with a hole bored therethrough by which the brake shoe 134 is rigidly and stationarily affixed to the frame of the knitting machine 20 by a bolt 136 and having another bracket 134'' formed in the other end thereof with a hole bored therethrough by which the two brake shoes 134 are joined by a bolt 138 extending through the holes to hold the brake shoes 134 in frictional engagement with the circumferential surface of the brake drum 132 within the channel 132' thereof. In this manner, a frictional drag resisting rotational movement of the brake drum 132 and accordingly of the pattern drum 86 is created, the degree of resistance being relatively substantial so that only the reciprocating racking force of the racking pawl 98 will overcome the drag whereby the undesired racking of the pattern drum 86 other than by the pattern drum racking assembly is prevented, all as is conventional.

As is clear from the above description of the conventional manner of operation of the knitting machine 20 and as will be understood by those skilled in the art, hosiery knitted on the machine 20 with a pattern area formed in accordance with the conventional manner of operation of the machine 20 will necessarily have two yarns, i.e. the pattern yarn and the background yarn, in plating relationship in each loop forming the patterned design of the pattern area. Moreover, to provide a continuity of appearance to the pattern area and hosiery as a whole, the yarns utilized are conventionally identical in yarn count and fiber or filament content. Accordingly, the aforementioned problems of the background yarn grinning through the design portion of the pattern area and of excess bulkiness of feel and appearance to the design portion result. Furthermore, conventional machines of the type of knitting machine 20 typically have limited design and stripping capabilities, due at least in part to the operation of the yarn feed fingers solely from the same pattern drum which controls the operation of many other machine functions.

In the present invention, however, an auxiliary yarn feed finger 112 is provided for selective feeding of a pattern background yarn G at a yarn feeding level 114 (FIG. 6) sufficiently closer spaced from the upper end of the cylinder 22 than the basic level 52 and axially inwardly of the latch assemblies 27 of needles 226 at the extended position so that the background yarn G will be presented to the needles 226 at the extended position below the latch assemblies 27 thereof and will not be received thereby for knitting but will be presented to and received for knitting by the latch assemblies 27 of needles 126 in the basic position. The feeding of the background yarn G in this manner conjunctively with the feeding of a pattern yarn P at the conventional pattern yarn feeding level 54 to needles 226 at the extended position will effect the floating of the background yarn G behind the loops of pattern yarn P formed by the needles 226 at the extended position that receive pattern yarn P, and will accordingly effectively eliminate the aforementioned problems of grinning and of imbalanced bulkiness in the pattern area.

As will be appreciated by those skilled in the art, such feeding of the pattern background yarn G at a lower feeding level more closely spaced form the upper end of the cylinder 22 than the basic yarn feeding level 52 cannot be conventionally accomplished on the knitting machine 20 or knitting machines of its generic type having only a single knitting station. Such machines characteristically are provided with a rigid, stationary throat plate 56 in the throat area 32' of the latch ring 32 thereof against the upper surface of which throat plate 56 a yarn feed finger rests when feeding yarn at the basic yarn feeding level 52. Accordingly, the yarn feed fingers 36 are conventionally incapable of feeding yarn at a level more closely spaced to the upper end of the cylinder 22 than the basic level 52. Moreover, as can be seen in FIG. 6, the conventional stationary camming means of the knitting machine 20 includes a center cam 116 at the knitting station 34 the purpose of which is to lower the needles 226 at the extended position to the basic position immediately subsequent to the receipt by such needles 226 of a pattern yarn to properly position such needles 226 with the needles 126 at the basic position for engagement thereof by the stitch cam 64 for stitch loop formation. In accordance with this function, the center cam 116 is disposed at the knitting station 34 immediately past the location of the yarn feeding positions of the numbers one and two pattern yarn feed fingers 44 and 45, respectively, as seen in the direction of cylinder rotation. For this reason, yarn feeding by the numbers three, six and seven yarn feed fingers 46, 49, and 50, respectively, which are conventionally utilized to feed yarn at the basic level 52, is not conventionally carried out while the needles 26 are projecting from the cylinder 22 at two distinctly different positions and, as a result, none of these feed fingers 46, 49, and 50 can effectively feed a background yarn to only the needles 126 at the basic position.

To overcome these conventional restrictions, the auxiliary yarn feed finger 112 of the present invention is disposed adjacent the upper end of the cylinder 22 intermediate the above-described needle selecting means of the stationary camming means of the machine 20 and the center cam 116 of the knitting station 34 approximately sixty degrees circumferentially in advance of the center cam 116 in relation to the direction of cylinder rotation and is adapted for vertical movement thereat into and out of a yarn feeding position for feeding background yarn G in the above-described manner. As can best be seen in FIGS. 3 and 4, the auxiliary feed finger 112 is vertically slidably disposed in a mounting bracket 118 affixed to the upper surface of the latch ring 32 at a location immediately above a point on the cylinder 22 approximately sixty degrees in advance of the center cam 116. To facilitate vertical movement of the auxiliary finger 112 into and out of its yarn feeding position at which its pattern background yarn feeding guide hole 112' is disposed at the aforementioned pattern background yarn feeding level 114 immediately radially outwardly of the latch assemblies 27 of the needles 126 in the basic position, a vertical slot 120 is formed in the inwardly facing curved surface of the latch ring 32 below the mounting bracket 118 in general alignment with the axis of the cylinder 22 (see FIG. 3). The lower edge 117 of the auxiliary feed finger 112 is formed with an angularly extending surface 117' to serve as a cam surface to engage the open latches 27' of the latch assemblies 27 of needles 26 when the auxiliary finger 112 is in its yarn feeding position to maintain the latches 27' open for receiving yarn.

As will be understood by those skilled in the art, the independent knitting of a pattern yarn P with selected cylinder needles 226 and a background yarn G with the remaining cylinder needles 126 provides no substantial interconnection or integration of the pattern portion of the pattern area and the remaining portions of the hosiery and, without some means of interrelating these respective portions of the hosiery, the portions will eventually separate. Therefore, in accordance with the present invention, the auxiliary feed finger 112 is operably associated with the pattern drum 86 for control of the movement thereof into and out of yarn feeding position through operative association thereof with the number seven yarn feed finger 50 for concerted movement of the auxiliary feed finger 112 and the number seven finger 50 into and out of their respective yarn feeding positions (see FIG. 4), whereby movement of the auxiliary feed finger 112 into its yarn feeding position will always necessarily require the simultaneous movement of the number seven finger 50 into its yarn feeding position. Since the number seven feed finger 50 follows the center cam 116 in the direction of cylinder rotation and since it is conventionally arranged to feed yarn at the basic level 52, yarn fed thereby will be received by the latch assemblies 27 of all cylinder needles 26. Thus, in the knitting of pattern areas of hosiery fabric in accordance with the present invention, only selected needles 26 raised to the extended position receive and knit the pattern yarn P, the remaining cylinder needles 26 receive and knit pattern background yarn G, and both groups of needles receive and knit a base yarn B fed by the number seven finger 50, whereby the base yarn B is knitted in plating relationship with the pattern and the background yarns P and G, respectively, in both the loops of pattern yarn P formed by the needles 226 at the extended position and the loops of background yarn G formed by the needles 126 at the basic position and effectively integrates the design portion of the pattern area with the remaining portions of the hosiery. Since every loop of every course in the pattern area thus formed includes two yarns, either the pattern or the background yarn P or G and the base yarn B, the aforementioned problem of disparity of the bulkiness of the pattern portion of the pattern area in relation to the remaining portions of the hosiery is generally alleviated. Moreover, according to the present invention, the base yarn B performs no function other than the interconnection of the design portion of the pattern area with the remainder of the hosiery and is not intended to form any part of the face of the hosiery fabric, whereby the base yarn B may be of a different yarn type and count than the pattern and background yarns P and B. Thus, in the present invention, the base yarn B fed by the number seven feed finger 50 is preferably a relatively strong synthetic yarn, e.g. nylon, of a significantly lower denier than the pattern and background yarns P and G, thereby virtually eliminating the possibility that the base yarn B will grin or otherwise show through the design portion of the pattern area.

Figure 4:
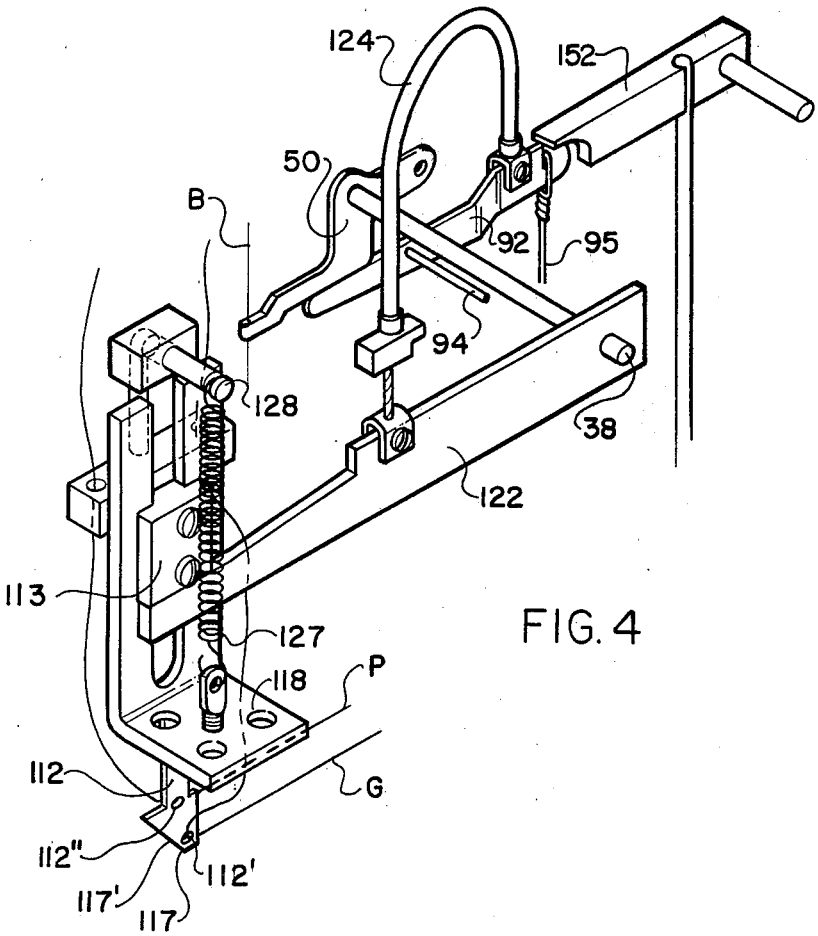
FIG. 4 is a perspective view of the auxiliary yarn feed finger arrangement of the yarn feed finger assembly of FIG. 3.

The abovementioned operative association between the auxiliary feed finger 112 and the number seven yarn feed finger 50 is best seen in FIG. 4. As is illustrated therein, the number seven finger 50 is pivotably mounted on the shaft 38 for movement into and out of its yarn receiving position actuated by movement of its respective feed finger lifter lever 92 downwardly about its shaft 94, all as is conventional. According to the present invention, an arm 122 is pivotably mounted on the shaft 38 at the opposite end thereof and extends therefrom into engagement with the lower surface of a block 113 affixed to the auxiliary feed finger 112, and a cable 124 extends from the rearwardly extending leg of the filter lever 92 associated with the number seven finger 50 so that pivotal movement of the lifter lever 92 about its shaft 94 effects unitary movement of the arm 122 about its shaft 38 in the same direction. The auxiliary feed finger 112, like the number seven finger 50, is urged toward its yarn feeding position by the biasing force of a spring 127 extending between the lower surface of the mounting bracket 118 affixed to the latch ring 32 and a rod 128 extending from the upper end of the auxiliary feed finger 112. Thus, pivotal movement of the feed finger lifter lever 92 associated with the number seven finger 50 to permit the lowering of the finger 50 into its yarn feeding position will unitarily and simultaneously effect pivotal movement of the arm 122 to permit the lowering of the auxiliary feed finger 112 into its yarn feeding position.

One embodiment and method of utilizing the auxiliary finger 112 of the present invention to knit pattern areas in hosiery is illustrated in FIG. 7. In accordance with this embodiment, a pattern area is knitting at the appropriate time during the hosiery knitting cycle and at the predetermined location on the hosiery according to the pattern drum and chain assembly of the knitting machine 20, by actuating and utilizing the auxiliary feed finger 112 to feed a pattern background yarn G at the aforementioned level 114 to the needles 126 at the aforementioned basic position while actuating and utilizing the number one feed finger 44 to conjunctively feed a pattern yarn P at the aforementioned conventional pattern yarn feeding level 54 to the needles 226 at the aforementioned extended position, the number seven feed finger 50 feeding a nylon base yarn B at the conventional basic level 52 to all needles 26 after the centering thereof to the basic position. However, as can best be seen in FIGS. 3 and 4, the auxiliary feed finger 112, in addition to the yarn guide hole 112' for feeding yarn at the level 114 when the auxiliary feed finger 112 is in its yarn feeding position, is provided with another yarn guide hole 112" spaced vertically above the guide hole 112' for feeding a pattern yarn P at the conventional pattern yarn feeding level 54. Thus, alternatively, the auxiliary feed finger 112 may be actuated and utilized for simultaneously feeding at its yarn receiving position both a pattern background yarn G at the level 114 to the needles 126 at the basic position and a pattern yarn P at the pattern yarn feeding level 54 to the needles 226 at the extended position (see FIG. 8). As is conventional, the numbers one and two pattern yarn feed fingers 44 and 45 may be adjusted if desired for feeding yarns at the basic level and therefore, under this latter embodiment, the number one yarn feed finger 44 is freed for uses other than the feeding of pattern yarn in the knitting of pattern areas and may be utilized for feeding another yarn for knitting stripes or other special color effects in the hosiery. As will accordingly be understood by those skilled in the art, the provision of the auxiliary feed finger 112 in conventional knitting machines of the type of knitting machine 20 can significantly increase their capabilities for knitting hosiery of more complex design and special color effects than they are conventionally capable of knitting.

As will be understood by those skilled in the art, it is very important in the formation of pattern areas according to the present invention that the pattern yarn P and the base yarn B fed by the number seven feed finger 50 be properly plated so that the pattern yarn P will appear on the face of the fabric. Thus, it is important that the pattern yarn P be disposed lower within the latch assemblies 28 of the needles 226 than the base yarn B when the needles engage the stitch cam 64. In the above-described first embodiment of the present invention in which the pattern yarn P is fed by the number one feed finger 44 in a conventional manner and the base yarn B is fed conventionally by the number seven feed finger 50, this is accomplished conventionally. However, in the second above-described embodiment of the present invention in which both the background and the pattern yarns are fed by the auxiliary feed finger 112, the needles 226 travel a relatively substantial distance in cylinder rotation from the location of the auxiliary feed finger 112 to the location of the number seven yarn feed finger 50 and therefore there is a greater likelihood that the pattern yarn P will not be maintained low within the latch assemblies 27 of the needles 226 and that accordingly proper plating of the pattern and base yarns P and B will not be accomplished.

To insure that the pattern yarn P and base yarn B will be properly plated in the operation of the knitting machine 20 according to the aforesaid second embodiment for appearance on the face of the fabric of the loops of the pattern yarn P knitted by the needles 226, means is provided in such embodiment for engaging the pattern yarn P during the initial feeding and receipt thereof by the needles 226 from the auxiliary feed finger 112 to move the pattern yarn P to a location relatively low within the latch assemblies 27 of the needles 226 at a closer spacing from the upper end of the cylinder than the basic level at which the base yarn B is fed. As can best be seen in FIG. 12, the pattern yarn engaging means includes a yarn camming plate 185 affixed to the knife and binder pad 187 of the knitting machine 20 which is disposed within the cylinder 22 of the machine 20 at the upper end thereof. The yarn camming plate 185 includes a base portion 186 through which are bored two holes for affixation of the plate 185 by screws 191 to the pad 187 generally centrally thereof. Extending from the upper surface of the base portion 186 radially outwardly of the cylinder 22 toward the knitting station 34 in generally parallel relation with the pad 187 at a slight spacing thereabove is a planar leg member 188 along the radially outwardly facing edge of which is formed a pattern yarn cam surface 189. The yarn cam surface 189 extends circumferentially with the cylinder 22 at a slightly radially inward spacing therewithin from a point 190 spaced above the surface of the pad 187 and in advance of the knitting station 34 sloping downwardly to a point following the knitting station 34.

As will be understood by those skilled in the art, the pattern yarn P, after the auxiliary feed finger 112 is moved out of its yarn feeding position, is carried by the last needle 226 to which it was fed circumferentially around the cylinder 22 and into a conventional yarn cutting device, indicated generally at 192, for severing the pattern yarn P, the free end of pattern yarn P from the yarn supply being held at that cutting location by conventional clamp or suction means or the like indicated at 193. Upon movement of the auxiliary feed finger 112 into its yarn feeding position to again begin feeding pattern yarn to extended needles 226, the first needle 226 to receive the pattern yarn P will carry it circumferentially around the cylinder 22 from the auxiliary feed finger 112 toward the knitting station 34. As the first needle 226 begins to move through the knitting station 34, the portion of cam surface 189 sloping upwardly toward point 190 will engage the length of the pattern yarn P extending from the first needle 226 to the suction or clamp means and will cause the pattern yarn P to be moved downwardly within the latch assembly 27 of the first needle 226 as cylinder 22 continues to rotate the first needle 226 past the knitting station 34 thereby moving the free end length of pattern yarn P along the cam surface 189. Once the first needle 226 has moved substantially past the knitting station 34, it will pull the free end length of the pattern yarn P from the suction or clamp means and the cam surface 189 ceases to engage the pattern yarn P, the initial camming of the pattern yarn P downwardly within the latch assembly 28 of the first needle 226 serving to effectively hold the pattern yarn P low within the latch assemblies 27 of the other following needles 226.

In accordance with another feature of the present invention, the capability of the knitting machine 20 for knitting stripes or other types of special color effects is additionally increased by the provision of an independently rotatable sleeve on the right end of the pattern drum 86 operably associated with at least some of the conventional yarn feed fingers 36 through operative association with their respective lifter levers 92 for selectively rendering such yarn feed fingers 36 inoperative in response to the control thereof by the main pattern drum 86. As can best be seen in FIGS. 10 and 11, a cylindrical pattern drum sleeve 140 is rotatably mounted and supported on the brake drum portion 132 of the pattern drum 86 and is provided with a plurality of circumferentially extending cam surfaces 142 and a ratchet wheel 144 affixed to the periphery of the sleeve 140. Associated with each circumferentially extending cam surface 142 is a drum reading lever 146 (FIG. 10) pivotably mounted on a shaft 145 and biased into following engagement with the periphery of the sleeve 140 by a respective spring 148 for following engagement with its respective cam surface 142. Connected to each drum reading lever 146 at the lower end thereof is a conventional Bowden cable 150. Each such Bowden cable 150 is operably connected at its other end with a yarn feed finger disengaging lever 152 (FIG. 3) pivotably mounted on a shaft 154 and extending therefrom into engagement with the upper surface of the rearwardly extending end of the yarn feed finger lifter levers 92 for downward pivotal movement about the shaft 154 to effect pivoting of the yarn feed finger lifter lever 92 about its shaft 94 and thereby effect pivoting of the respective yarn feed finger 36 out of its yarn feeding position. As can be seen in FIG. 3 of the illustrated embodiment of this feature of the present invention, a feed finger disengaging lever 152 is mounted on the shaft 154 in association with each of the feed finger lifter levers 92 associated with the numbers two, three, four, six and seven feed fingers 45, 46, 47, 49, 50, respectively. In this manner, the conventional control of the movement of yarn feed fingers 45, 46, 47, 49, 50 and the control of the auxiliary feed finger 112 by the pattern drum 86 can be selectively overriden by the selective location of cam surfaces 142 on the pattern drum sleeve 140, the engagement of a cam surface by any of the drum reading levers 146 causing pivotal movement of the lever 146 about its shaft 145 and accordingly exerting a pulling force on its respective cable 150 to pivot its respectively associated feed finger disengaging lever 152 into engagement with its respective feed finger lifter lever 92 to pivot or maintain the respective feed finger 36 out of its feeding position.

Figure 10:
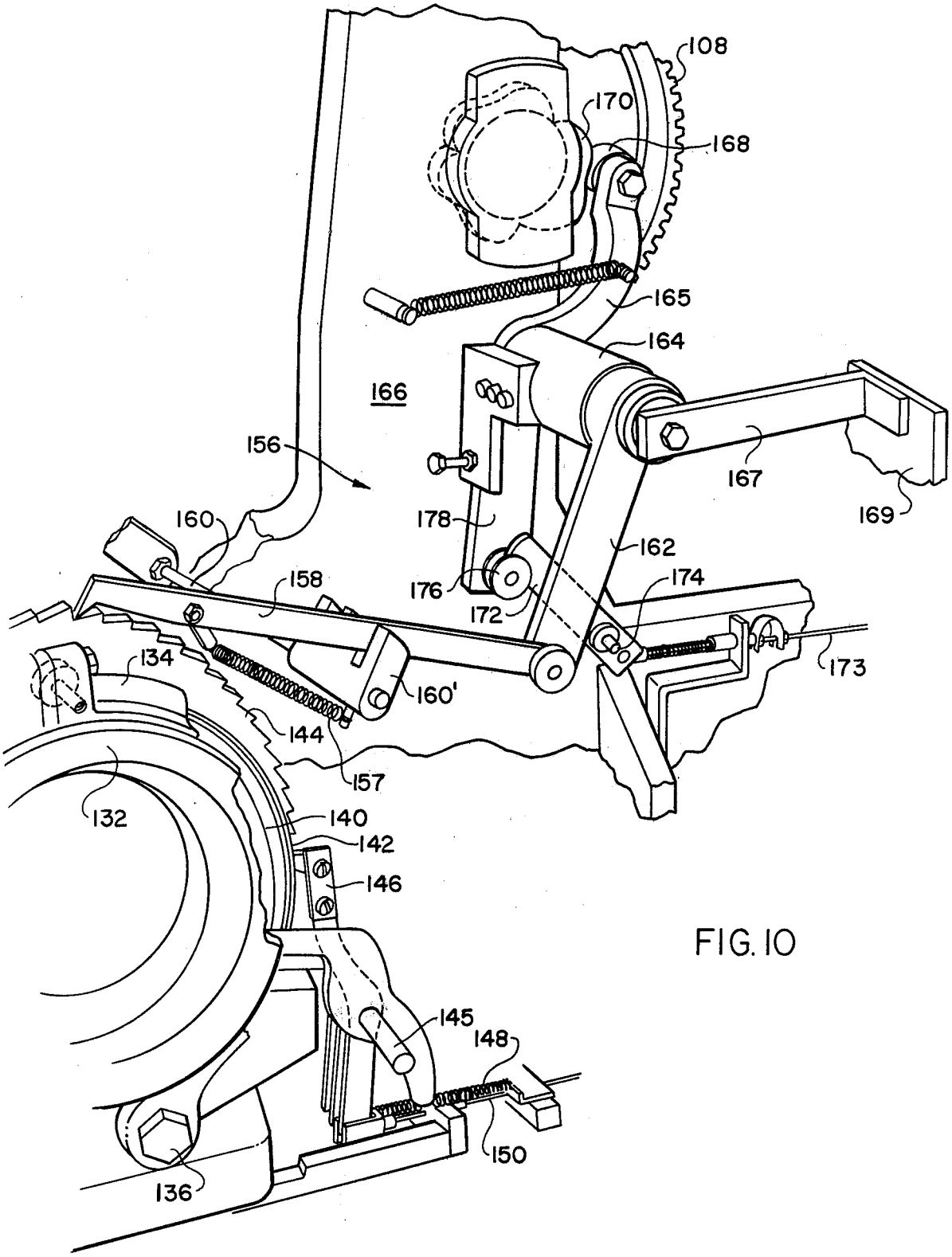
FIG. 10 is a perspective view of the pattern drum sleeve and the pattern drum sleeve rotating means of the knitting machine of FIG. 1.

Associated with the pattern drum sleeve 140 is means for rotating the pattern drum sleeve 140 independently of the pattern drum 86, such rotating means comprising a racking assembly indicated generally at 156 in FIG. 10. As indicated above, the pattern drum sleeve 140 includes a circumferentially extending ratchet wheel 144, the sleeve racking assembly 156 including a ratchet pawl 158 supported on a support arm 160 in a slotted bracket 160' therein in generally tangential relation with the ratchet wheel 144 and biased into driving engagement with the teeth 144' of the ratchet wheel 144 by a spring 157 extending from the pawl 158 to the support arm 160. The ratchet pawl 158 is pivotably affixed to an arm 162 rigidly affixed to and extending from one end of a shaft 164 which is rotatably journaled at its other end in an upright member 166 of the machine frame and is supported at the aforesaid one end thereof by a stabilizer support arm 167 extending from another machine frame member 169. Rigidly affixed to and extending from the aforementioned other end of shaft 164 is another arm 165 on which is rotatably mounted a cam follower roller 168 biased into following engagement with the cams 170 positioned on the timing gear component 108 of the above-described pattern drum racking assembly, whereby the continuous rotation of the timing gear 108 and of the cams 170 thereon effects reciprocation of the arm 165 resulting in reciprocation of the shaft 164 and of the ratchet pawl 158 and accordingly effects the stepwise rotation of the ratchet wheel 144 and the pattern drum sleeve 140. To facilitate the selective engagement and disengagement of the pattern drum sleeve racking assembly 156, a lever 172, pivotably mounted about a shaft 174 and operatively associated with the main pattern drum 86 by a conventional Bowden cable 173 for control of the pivotal movement thereof, is provided for pivotal movement into and out of engagement with a roller 176 affixed to a leg bracket 178 rigidly affixed to and extending generally oppositely of the arm 165 from the aforesaid other end of the shaft 164, whereby the shaft 164 may be selectively rotated by engagement of the roller 176 with the lever 172 to disengage the cam follower roller 168 from following engagement with the cams 170 and accordingly prevent reciprocation of the ratchet pawl 158.

The pattern drum sleeve 140 is also provided with its own sleeve brake means operable to create a drag or resistance against rotation of the pattern drum sleeve 140 to thereby prevent rotational movement of the pattern drum sleeve 140 other than by the above-described pattern drum sleeve racking assembly 156. For this purpose, a metal rod 180 (FIG. 11) is trained about the periphery of the pattern drum sleeve 140 at the outwardly facing edge thereof, the two ends of the rod 180 being threaded and affixed by nuts 182 to a support bracket 184 rigidly affixed to the knitting machine frame to hold the rod 180 in relatively tight frictional engagement with the sleeve 140 to thereby resist rotational movement of the sleeve 140. In this manner, rotation of the sleeve 140 upon rotation of the main pattern drum is prevented, whereby the sleeve 140 and main drum 86 may be operated independently.

As will be understood by those skilled in the art, the above-described arrangement of the pattern drum sleeve 140 and yarn feed finger disengaging levers 152 significantly increases the capability of the knitting machine 20 for knitting hosiery having special color effects, particularly stripes. As noted above, one of the major limitations of conventional hosiery knitting machines in this regard is the control of the yarn feed fingers solely by the main pattern drum 86 and its associated pattern chain assembly and, although it is possible conventionally to expand the size and capacity of the main pattern drum, it nevertheless provides the sole control for the yarn feed fingers thereby necessitating relatively large and cumbersome pattern drum and pattern chain arrangements to facilitate the knitting of more complex striping and other color effects. Significantly, the present cooperative arrangement of the pattern drum sleeve 140 and the yarn feed finger disengaging levers 152 provides an independently operable mean of controlling the movements of the yarn feed fingers 36 in conjunction with the control thereof by the main pattern drum 86 thereby providing a means of determining supplementary programs for controlling the yarn feed fingers 36 and the auxiliary feed finger 112 and accordingly greatly expanding the capacity of conventional hosiery knitting machines for knitting hosiery with complex striping and other special color effects all without increasing the size of the main pattern drum thereof and its associated pattern chain assembly.

The present invention has been hereinabove described in detail with regard to the preferred embodiments thereof. However, as those skilled in the art will readily recognize, modifications and variations may be resorted to without departing from the substance or scope of the present invention. Such modifications and variations are within the scope of the present invention which is intended to be limited only by the appended claims and equivalents thereof.

I claim:

1. In a circular knitting machine of the type having a rotatable needle cylinder, a plurality of needles carried in said cylinder, a knitting station, a plurality of yarn feed fingers associated with said knitting station and independently movable into and out of respective yarn feeding positions for selectively feeding yarns to said needles, and means for manipulating said needles axially of said cylinder for projection from one end thereof to receive yarn for knitting from said feed fingers and including means for selectively positioning each said needle in axial projection from said end of said cylinder at either of two positions for receiving yarn for knitting, said two positions being a basic position for base yarn fed at a basic yarn feeding level spaced from said end of said cylinder and an extended position in which said needles project from said end of said cylinder to a greater axial extent than in said basic position for receiving both pattern yarn fed at a pattern yarn feeding level spaced farther from said end of said cylinder than said basic level and said base yarn fed at said basic level, the improvement comprising an auxiliary feed finger selectively movable into and out of a yarn feeding position for selectively feeding a pattern background yarn at a yarn feeding level more closely spaced from said end of said cylinder than said basic level for receipt by needles at said basic position for knitting without being received for knitting by needles at said extended position, said pattern background yarn thereby floating behind loops of said pattern yarn formed by the needles at said extended position that receive said pattern yarn.

2. The improvement in a circular knitting machine according to claim 1 and characterized further in that said plurality of yarn feed fingers includes a pattern yarn feed finger adapted for feeding at its yarn feeding position said pattern yarn at said pattern yarn feeding level.

3. The improvement in a circular knitting machine according to claim 1 and characterized further in that said auxiliary feed finger is adapted for feeding at its feeding position a pattern yarn at said pattern yarn feeding level simultaneously with its feeding of said pattern background yarn.

4. The improvement in a circular knitting machine according to claims 1, 2 or 3 and characterized further in that said needles are latch needles each having an openable latch assembly thereon for projection from said end of said cylinder with said latch assembly open for receiving yarn for knitting, said pattern background yarn feeding level of said auxiliary feed finger being at a sufficiently closer spacing from said end of said cylinder than said basic level axially inwardly of the latch assemblies of needles at said extended position so that said pattern background yarn will not be presented for knitting to said latch assemblies of said needles at said extended position but will be presented to and received for knitting only by the latch assemblies of needles in said basic position.

5. The improvement in a circular knitting machine according to claims 1, 2 or 3 and characterized further in that said knitting station includes center cam means for moving said needles from said extended position to said basic position, in that said means for selectively positioning needles is disposed in advance of said knitting station, and in that said auxiliary feed finger is disposed intermediate said means for selectively positioning needles and said knitting station center cam means.

6. The improvement in a circular knitting machine according to claim 5 and characterized further in that said plurality of yarn feed fingers includes a base yarn feed finger disposed at said knitting station following said center cam means and adapted for feeding at its yarn feeding position said base yarn at said basic level to all said needles after said moving of said needles from said extended position to said basic position.

7. The improvement in a circular knitting machine according to claim 6 and characterized further in that said auxiliary feed finger and said base yarn feed finger are operatively connected for concerted movement thereof into and out of their respective yarn feeding positions.

8. The improvement in a circular knitting machine according to claim 5 and characterized further in that said knitting machine includes a ring at said end of said cylinder having a throat area within which each of said plurality of yarn feed fingers is disposed when in its said respective yarn feeding position, said ring having a slot formed therein in general alignment with the axis of said cylinder for movement of said auxiliary feed finger therein.

9. The improvement in a circular knitting machine according to claim 8 and characterized further in that said needles are latch needles each having an openable latch for receiving yarn for knitting, in that said ring is a latch ring for engaging the latches of said needles when the latches are open to maintain said latches open for receiving yarn, and in that said auxiliary feed finger includes a cam surface thereon for engaging said open latches of said needles when said auxiliary feed finger is in its feeding position to maintain said latches open for receiving yarn.

10. The improvement in a circular knitting machine according to claim 3 and characterized further in that said knitting station includes center cam means for moving said needles from said extended position to said basic position, said means for selectively positioning needles being disposed in advance of said knitting station, said auxiliary feed finger being disposed intermediate said means for selectively positioning needles and said knitting station center cam means, and said plurality of yarn feed fingers including a base yarn feed finger disposed at said knitting station following said center cam means for feeding at its yarn feeding position said base yarn at said basic level to all said needles after said moving of said needles from said extended position to said basic position, and characterized further by means for engaging said pattern yarn during the initial feeding thereof to and receipt thereof by needles at said extended position to move said pattern yarn on said needles at said extended position to a closer spacing to said end of said cylinder than said basic level of feeding of said base yarn to effect proper plating of said pattern yarn with respect to said base yarn for appearance of loops of said pattern yarn knitted by said needles at said extended position on the face of the fabric knitted.

11. The improvement in a circular knitting machine according to claims 1, 2 or 3 and characterized further in that said knitting machine includes a rotatable pattern drum operatively associated with said plurality of yarn feed fingers for controlling movement of said yarn feed fingers into and out of their respective yarn feeding positions, and in that said pattern drum is operatively associated with said auxiliary feed finger for controlling movement thereof into and out of its yarn feeding position, and further comprising a pattern drum sleeve supported coaxially about said pattern drum for independent rotation thereon, said pattern drum sleeve being operatively associated with at least some of said plurality of yarn feed fingers and with said auxiliary feed finger for selectively rendering said some yarn feed fingers and said auxiliary feed finger inoperative in response to the control thereof by said pattern drum.

12. The improvement in a circular knitting machine according to claim 11 and characterized further in that said auxiliary yarn feed finger is operatively connected with one of said some yarn feed fingers for concerted movement of said one feed finger and said auxiliary feed finger into and out of their respective yarn feeding positions, said pattern drum being operatively associated with said one feed finger for controlling said concerted movement and said pattern drum sleeve being operatively associated with said one feed finger for selectively concertedly rendering both said one feed finger and said auxiliary feed finger inoperative in response to the control thereof by said pattern drum.

13. The improvement in a circular knitting machine according to claim 12 and characterized further by a plurality of yarn feed finger disengaging levers associated with said some yarn feed fingers for independently moving said some yarn feed fingers out of their respective yarn feeding positions, said pattern drum sleeve being independently operatively associated with each said yarn feed finger disengaging lever for selectively and independently controlling movement of each of said some yarn feed fingers out of their respective yarn feeding positions.

14. The improvement in a circular knitting machine according to claim 11 and characterized further in that said knitting machine includes means for rotating said pattern drum and brake means for preventing movement of said pattern drum other than by said pattern drum rotating means, and characterized further by means for rotating said pattern drum sleeve independent of said pattern drum and pattern drum sleeve brake means operable to prevent movement of said pattern drum sleeve other than by said pattern drum sleeve rotating means.

15. In a circular knitting machine of the type having a rotatable needle cylinder, a plurality of needles carried in said cylinder, a plurality of yarn feed fingers independently movable into and out of respective yarn feeding positions for selectively feeding yarns to said needles, and a rotatable pattern drum operatively associated with said plurality of yarn feed fingers for controlling movement of said yarn feed fingers into and out of their respective yarn feeding positions, the improvement comprising a pattern drum sleeve supported coaxially about said pattern drum for independent rotation thereon, said pattern drum sleeve being operatively associated with at least some of said yarn feed fingers for selectively rendering said some yarn feed fingers inoperative in response to the control thereof by said pattern drum.

16. The improvement in a circular knitting machine according to claim 15 and characterized further by a plurality of yarn feed finger disengaging levers associated with said some yarn feed fingers for independently moving said some yarn feed fingers out of their respective yarn feeding positions, said pattern drum sleeve being independently operatively associated with each said yarn feed finger disengaging lever for selectively and independently controlling movement of each of said some yarn feed fingers out of their respective yarn feeding positions.

17. The improvement in a circular knitting machine according to claim 15 and characterized further in that said knitting machine includes means for rotating said pattern drum and brake means for preventing movement of said pattern drum other than by said pattern drum rotating means, and characterized further by means for rotating said pattern drum sleeve independent of said pattern drum and pattern drum sleeve brake means operable to prevent movement of said pattern drum sleeve other than by said pattern drum sleeve rotating means.

18. In method of knitting circular fabric on a circular knitting machine of the type having a rotatable needle cylinder, a plurality of needles carried in said cylinder, and a knitting station, wherein yarns are selectively and independently fed to said needles at said knitting station and said needles are selectively positioned in axial projection from an end of said cylinder at either a basic position for receiving for knitting yarn fed at a basic yarn feeding level spaced from said end of said cylinder or an extended position in which said needles project from said end of said cylinder to a greater axial extent than in said basic position for receiving for knitting both pattern yarn fed at a pattern yarn feeding level spaced farther from said end of said cylinder than said basic level and base yarn fed at said basic level, the improvement comprising feeding a pattern background yarn at a yarn feeding level more closely spaced from said end of said cylinder than said basic level for receipt by needles at said basic position for knitting without being received for knitting by needles at said extended position whereby said pattern background yarn floats behind loops of said pattern yarn formed by the needles at said extended position that receive said pattern yarn.

19. The improvement in a method of knitting circular fabric according to claim 18 and characterized further in that said feeding of said pattern background yarn occurs at a spacing from and in advance of said knitting station and characterized further by feeding at said knitting station said pattern yarn at said pattern yarn feeding level for receipt by needles at said extended position.

20. The improvement in a method of knitting circular fabric according to claim 18 and characterized further in that said feeding of said pattern background yarn occurs at a spacing from and in advance of said knitting station and characterized further by feeding said pattern yarn at said pattern yarn feeding level for receipt by needles at said extended position simultaneously with said feeding of said pattern background yarn.

21. The improvement in a method of knitting circular fabric according to claim 18, 19 or 20 and characterized further by moving said needles from said extended knit position to said basic position after said feeding of said pattern background yarn and said pattern yarn, and the feeding said base yarn at said basic level to all said needles.

* * * * *

UNITED STATES PATENT OFFICE

CERTIFICATE OF CORRECTION

Patent No. 4,328,686 Dated May 11, 1982

Inventor(s) Jack C. Barbee et al

It is certified that error appears in the above-identified patent and that said Letters Patent are hereby corrected as shown below:

Column 8, line 15, delete "46" and insert therefor --45--.
Column 19, line 56, after "for" insert --receiving--.
Column 23, line 6, after "position" insert --,--.

Signed and Sealed this

*Fourteenth* Day of *December 1982*

[SEAL]

*Attest:*

GERALD J. MOSSINGHOFF

*Attesting Officer*

*Commissioner of Patents and Trademarks*